US011398666B2

(12) United States Patent
Kho et al.

(10) Patent No.: US 11,398,666 B2
(45) Date of Patent: Jul. 26, 2022

(54) PLANAR ANTENNA CLAMP SYSTEM

(71) Applicant: United States Government as represented by the Secretary of the Navy, San Diego, CA (US)

(72) Inventors: Yong An Kho, Chula Vista, CA (US); Steven E. Mancewicz, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 113 days.

(21) Appl. No.: 16/851,554

(22) Filed: Apr. 17, 2020

(65) Prior Publication Data

US 2021/0328323 A1 Oct. 21, 2021

(51) Int. Cl.
*H01Q 1/12* (2006.01)
*H01Q 9/04* (2006.01)

(52) U.S. Cl.
CPC ..... *H01Q 1/1235* (2013.01); *H01Q 9/045* (2013.01)

(58) Field of Classification Search
CPC ..... H01Q 1/088; H01Q 1/1235; H01Q 1/20; H01Q 1/22; H01Q 1/12; H01Q 1/1207; H01Q 9/045
USPC ..... 343/700 R
See application file for complete search history.

(56) References Cited

U.S. PATENT DOCUMENTS 5,005,019 A * 4/1991 Zaghloul ..... H01Q 9/0414 166/270.1
5,812,098 A * 9/1998 Harris ..... H01Q 1/244 343/702
2007/0133156 A1* 6/2007 Ligtenberg ..... G06F 1/1616 361/679.3
2008/0012788 A1* 1/2008 Brocheton ..... H01Q 1/1207 343/906
2009/0009421 A1* 1/2009 Suprunov ..... H01Q 21/28 343/881
2012/0306715 A1* 12/2012 Montgomery ..... H01Q 1/246 343/835
2016/0181867 A1* 6/2016 Daniel ..... H01Q 9/26 307/104

* cited by examiner

*Primary Examiner* — Dameon E Levi
*Assistant Examiner* — Leah Rosenberg
(74) *Attorney, Agent, or Firm* — Naval Information Warfare Center, Pacific; Kyle Eppele; Evan Hastings

(57) ABSTRACT

A planar antenna clamp system comprising: a base; a connector mounted to the base; a clamp arm mounted to the base such that, when in an open configuration, an air gap exists between the top surface of the base and the bottom surface of the clamp arm's distal end, and wherein the clamp arm and the base are oriented with respect to one another such that conductors of a planar antenna may be positioned in the air gap when in the open configuration; a matching circuit disposed on the top surface of the base and electrically connected to the connector; and a clamp configured to compress the conductors of the planar antenna between the top surface of the base and the bottom surface of the clamp arm such that the conductors of the planar antenna are operatively coupled with the matching circuit, when in a closed configuration.

16 Claims, 10 Drawing Sheets

Open Configuration

Closed Configuration

PLANAR ANTENNA CLAMP SYSTEM

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 111504.

BACKGROUND OF THE INVENTION

FIG. 1 is a top-view illustration of an example of prior art planar antenna 10 that is built on a printed circuit board 12. As is typical with prior art planar antennas, the planar antenna 10 shown in FIG. 1 is soldered directly to a connector 14. Other times the connector 14 is soldered directly to a transmission line from the antenna 10. This is done to enable the antenna 10 to be connected to a transmitter or a receiver, such as the communication device 16 shown in FIG. 1. Although this is an effective setup, some disadvantages exist. For example, if higher quality and more expensive connectors are used, these connectors can cost more than the planar antennas themselves and if they are soldered onto the planar antennas, the connectors cannot be easily reused. Soldering the connector directly to the planar antenna could damage the antenna if it is made of a material (e.g., paper and plastic) that is sensitive to the heat involved with soldering. Further, it is not easy to quickly and easily swap out planar antennas in some applications. There is a need for an improved method of connecting a planar antenna to a communication device.

SUMMARY

Disclosed herein is a planar antenna clamp system comprising:
a base, a connector, a clamp arm, a matching circuit, and a clamp. The base has a top surface. The connector is mounted to the base and configured to provide an interface to a communication device. The clamp arm has top and bottom surfaces and proximal and distal ends. The proximal end of the clamp arm is mounted to the base such that, when in an open configuration, an air gap exists between the top surface of the base and the bottom surface of the clamp arm at a distal end of the clamp arm. The clamp arm and the base are oriented with respect to one another such that conductors of a planar antenna may be positioned in the air gap when in the open configuration. The matching circuit is disposed on the top surface of the base and electrically connected to the connector. The clamp is configured to compress the conductors of the planar antenna between the top surface of the base and the bottom surface of the clamp arm such that the conductors of the planar antenna are operatively coupled with the matching circuit, when in a closed configuration.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed system below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1:
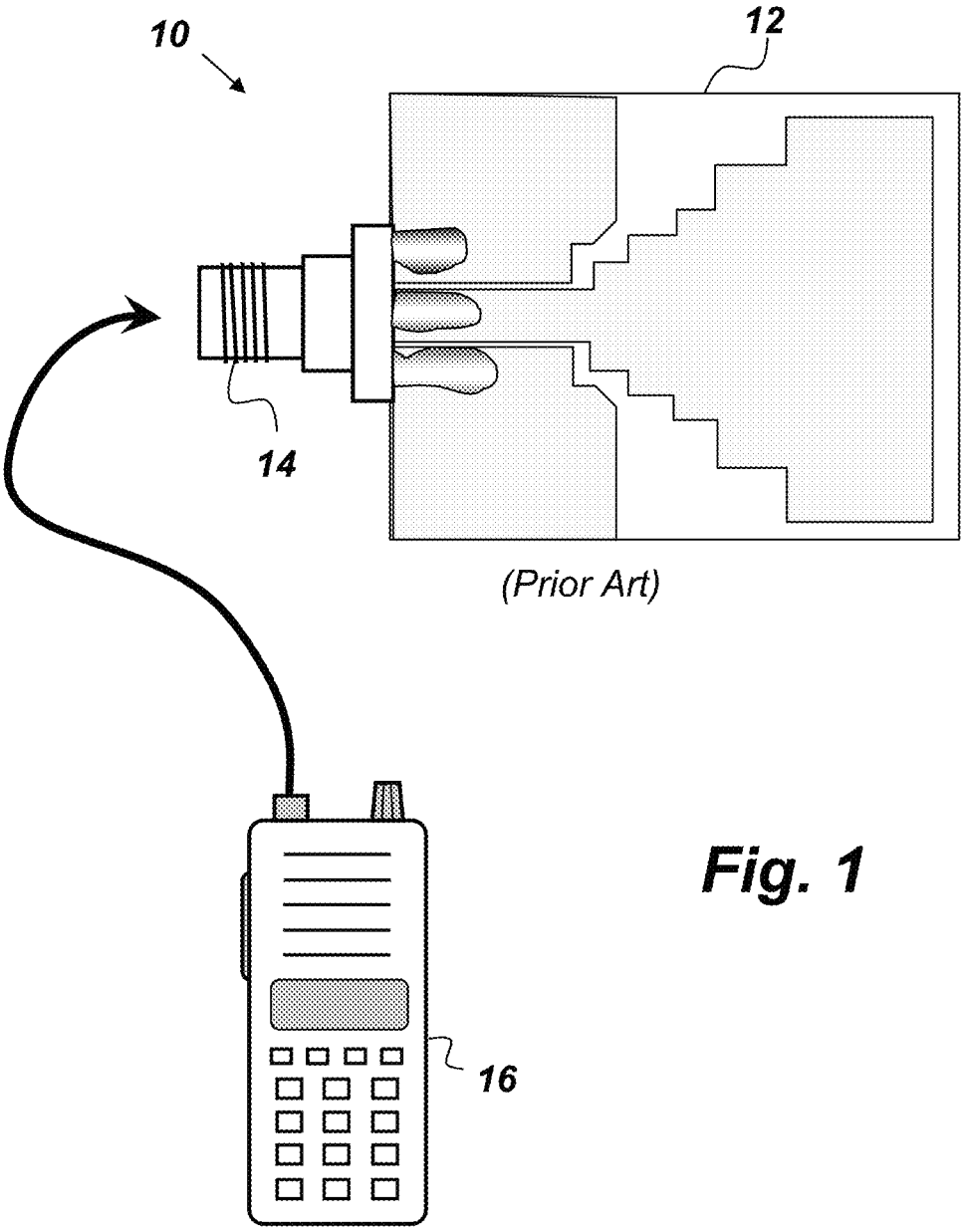
(Prior Art) Fig. 1
FIG. 1 is an illustration of a prior art version of a planar antenna with a soldered connector.
Figure 2:
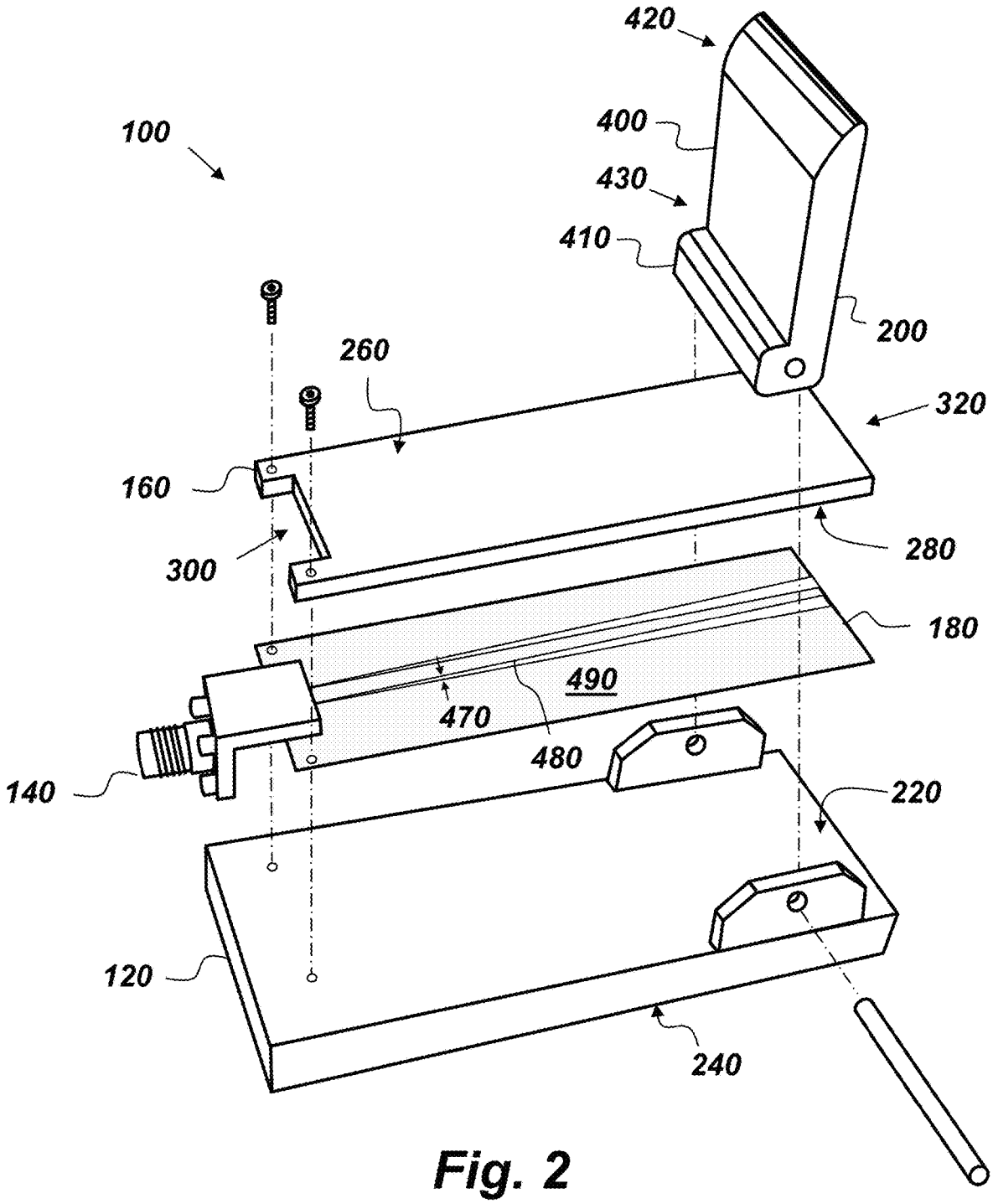
FIG. 2 is an expanded view illustration of an embodiment of a planar antenna clamp system.
Figure 5:
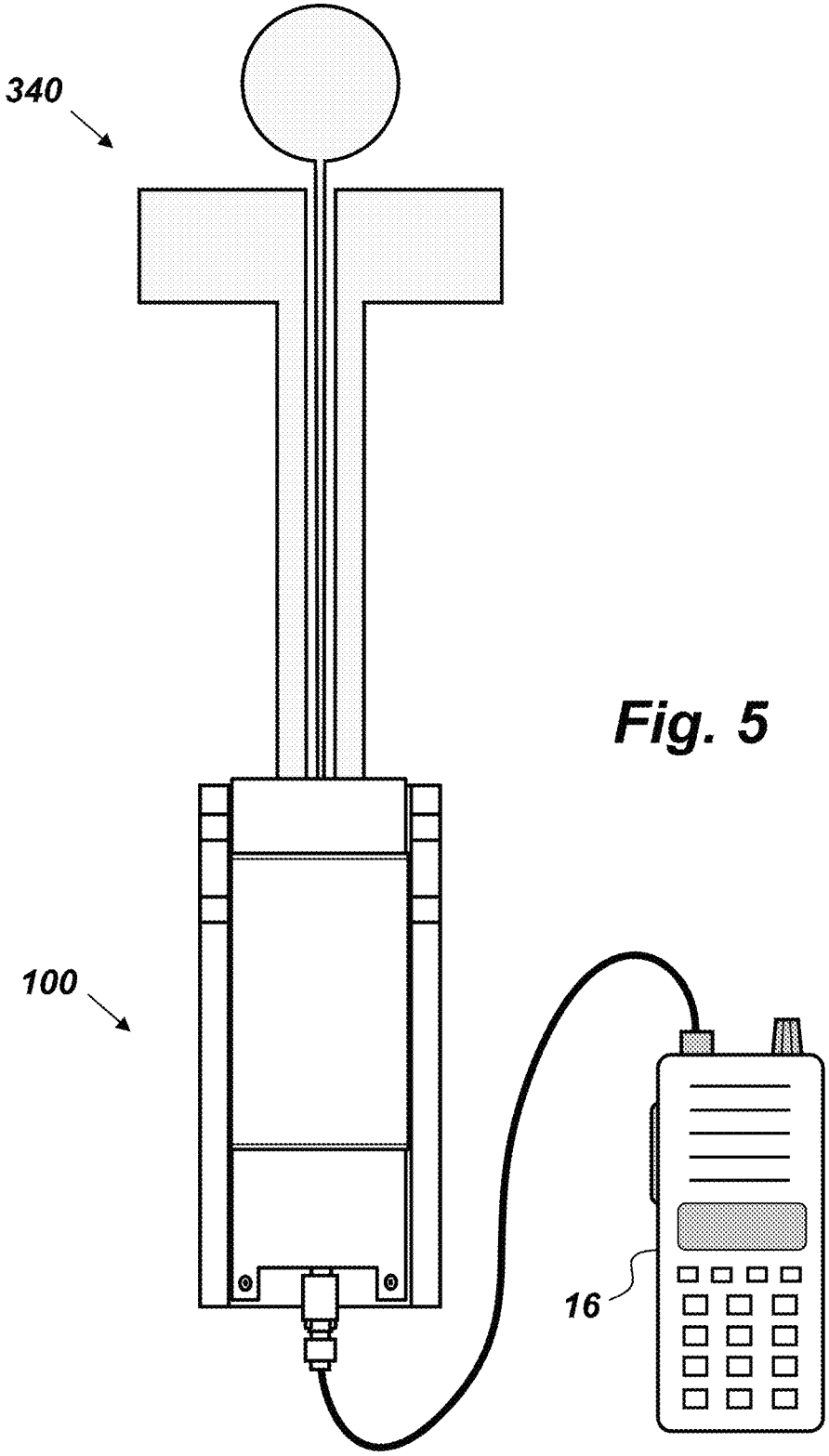
FIG. 5 is a top-view illustration of an embodiment of a planar antenna clamp system.

FIG. 2 is an expanded-view of an embodiment of a planar antenna clamp system 100 that comprises, consists of, or consists essentially of a base 120, a connector 140, a clamp arm 160, a matching circuit 180, and a clamp 200. The planar antenna clamp system 100 may be used to quickly connect a planar antenna to the matching circuit 180 and the connector 140 so as to provide an interface to a communication device (such as shown in FIGS. 1 and 5) such as a transmitter, receiver, or a transceiver. The planar antenna clamp system 100 enables planar antennas, even fragile ones such as those made of porous material, plastic, or even paper, to be connected to a communication device (such as the radio 16 depicted in FIG. 1) without the need for soldering. The base 120 has a top surface 220 and a bottom surface 240. The connector 140 is mounted to the base 120. The clamp arm 160 has a top surface 260, a bottom surface 280, a proximal end 300, and a distal end 320. The matching circuit 180 is disposed on the top surface 220 of the base 120 and is electrically connected to the connector 140. In some embodiments, the matching circuit 180 may be mounted on a separate substrate which is sandwiched between the top surface 220 of the base 120 and the bottom surface 280 of the clamp arm 160.

Figure 3A:
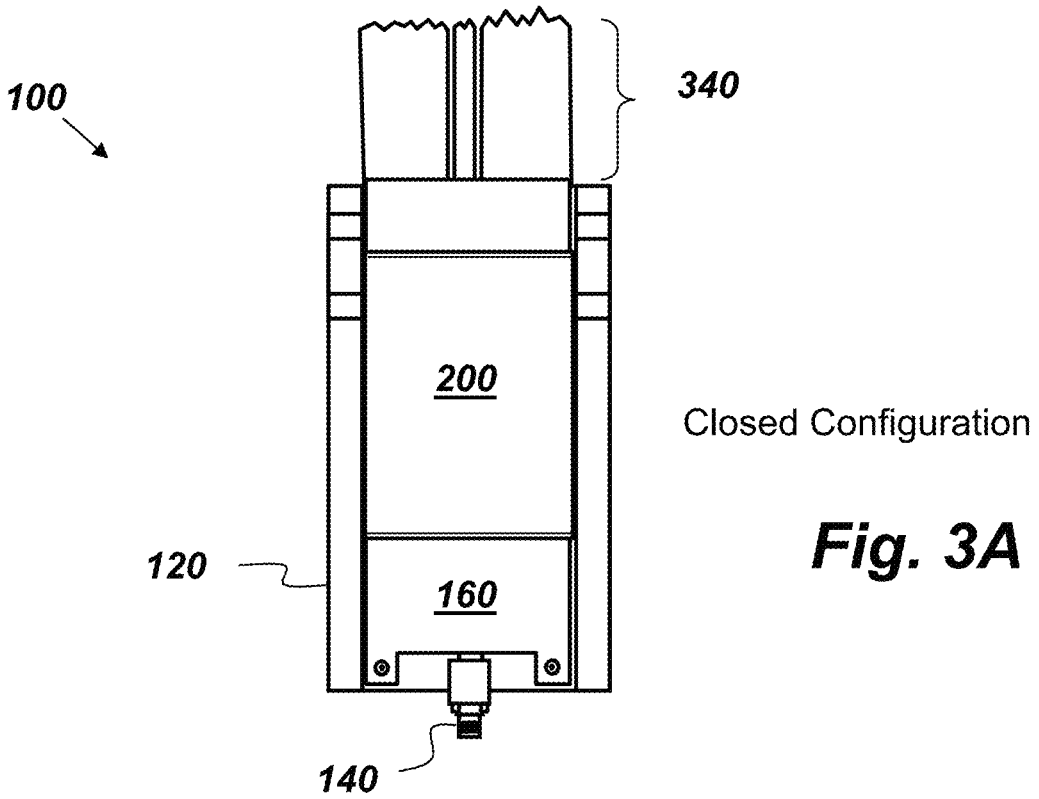
FIGS. 3A and 3B are respectively top and perspective-view illustrations of an embodiment of a planar antenna clamp system in a closed configuration.
Figure 3B:
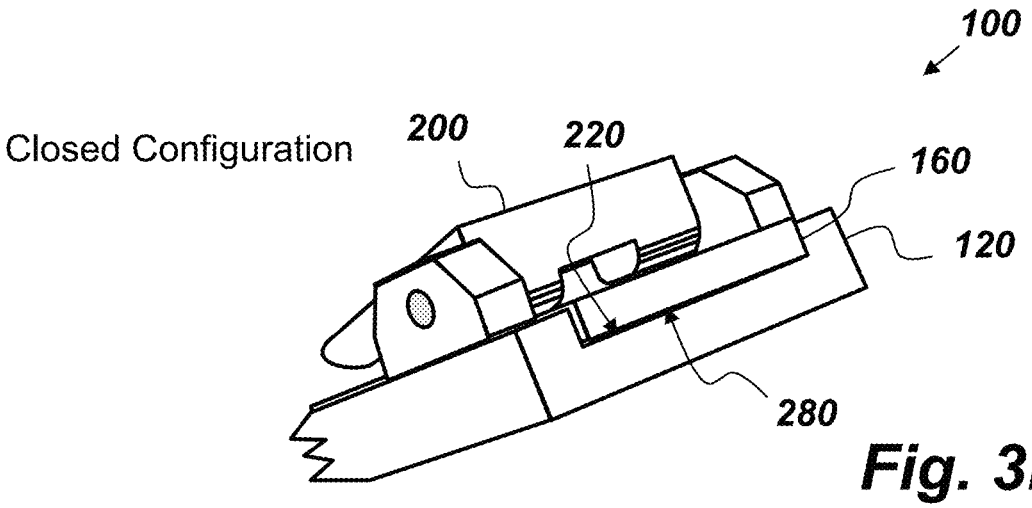
Figure 4A:
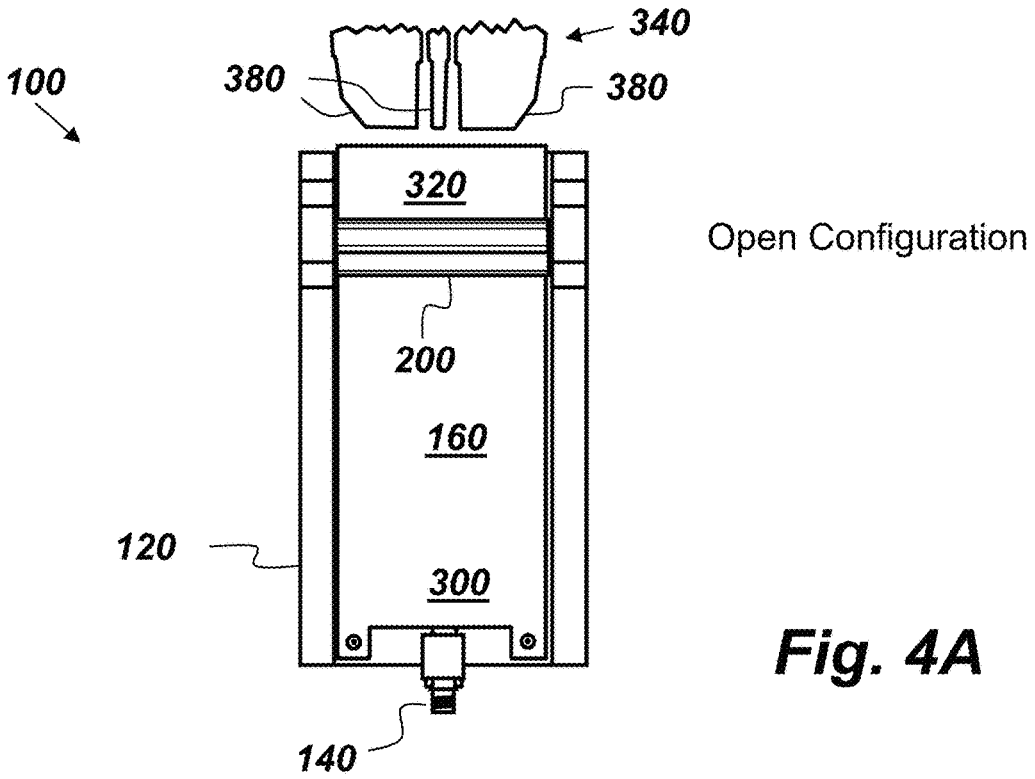
FIGS. 4A and 4B are respectively top and perspective-view illustrations of an embodiment of a planar antenna clamp system in an open configuration.

FIGS. 3A and 3B are respectively partial, top-view and partial, perspective-view illustrations of an embodiment of the planar antenna clamp system 100 in a closed configuration. The clamp 200 is configured to compress a planar antenna 340 between the matching circuit 180, which is disposed on the top surface 220 of the base 120, and the bottom surface 280 of the clamp arm 160 such that conductors (such as are shown in FIG. 4A) of the planar antenna 340 are operatively coupled with the matching circuit 180, when in the closed configuration. The planar antenna 340 is not shown in FIG. 3B for ease of illustration.

Figure 4B:
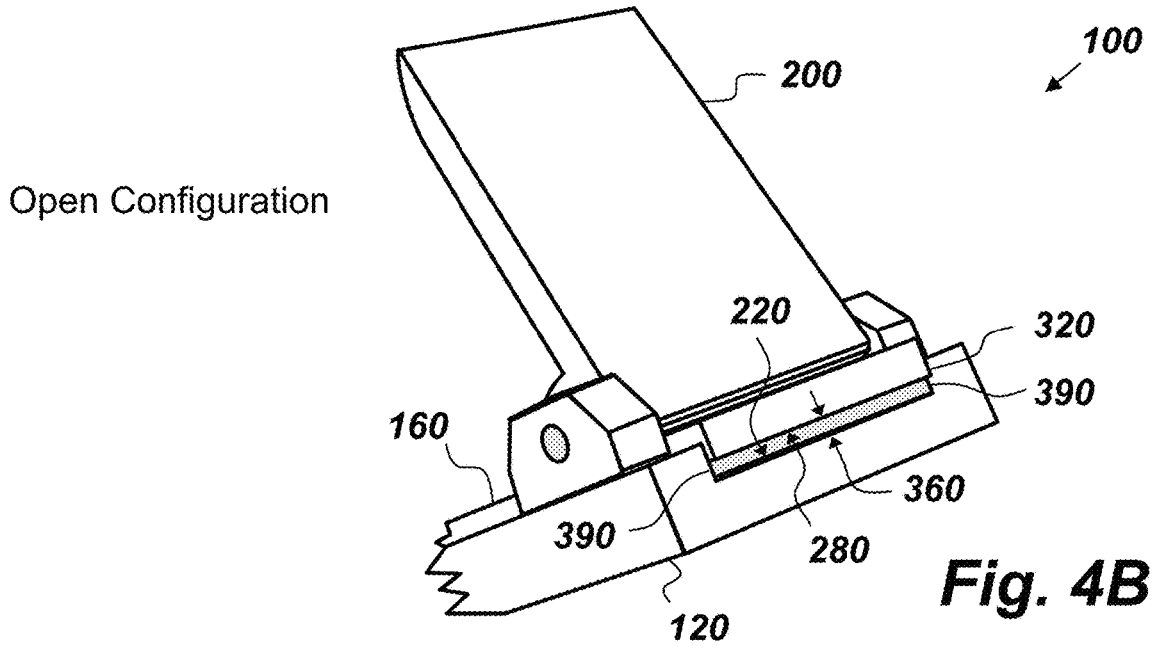

FIGS. 4A and 4B are respectively partial, top-view and partial, perspective-view illustrations of an embodiment of the planar antenna clamp system 100 in an open configuration. The proximal end 300 of the clamp arm 160 is mounted to the base 120 such that, when in the open configuration, an air gap 360 exists between the matching circuit 180 and the bottom surface 280 of the clamp arm 160 at the distal end 320 of the clamp arm 160. The clamp arm 160 and the base 120 are oriented with respect to one another such that conductors 380 of the planar antenna 340 may be positioned in the air gap 360 when in the open configuration. The planar antenna 340 is not shown in FIG. 4B for ease of illustration.

FIG. 5 is a top-view illustration of an example planar antenna 340 connected to the planar antenna clamp system 100, which, in turn, is connected to a communication device 16. The planar antenna clamp system 100 may be used with any type of planar antenna. Suitable examples of planar antennas include, but are not limited to, patch antennas, slot antennas, ring antennas, spiral antennas, bow-tie antennas, tapered-slot antennas, Yagi slot antennas, quasi-Yagi antennas, log-periodic dipole array antennas, and leaky wave antennas. Planar antennas have been used in many applications because they can be low-cost, low-profile, and can be mass produced. The planar antenna clamp system 100 transitions the antenna 340's impedance to a desired impedance, which in most cases is 50 ohms. However, it is to be understood that that planar antenna clamp system 100 may be configured to transition the antenna 340's impedance to any other desired impedance. The planar antenna clamp system 100 allows for different antennas 340 to be quickly swapped depending on the target signal of interest. In some embodiments, the planar antenna clamp system 100 may be the only means of supporting the antenna 340.

The base 120 may be any desired size and shape that allows the conductors 380 of the planar antenna 340 to be pressed between the bottom surface 280 of the clamp arm 160 and the matching circuit 180. In some embodiments, the base 120 may be made of a low loss material, non-conductive material such as plastics (ABS, POM, Nylon, Polypropylene, Polycarbonate, PLA), composites (fiberglass, carbon fiber, Kevlar), glass, and ceramics. In some embodiments, the base 120 comprises a nonconductive substrate, to which the matching circuit 180 is mounted and a supporting base section, which may be conductive such as, but not limited to, stainless steel and aluminum. Suitable examples of material from which the base 120 may be constructed include, but are not limited to, metal, plastic (e.g., ABS, Delrin, Rexolite®, nylon, etc.), glass, and printed circuit board material (FR4, Rodgers, Teflon, etc.).

In the embodiment of the planar antenna clamp system 100 shown in FIGS. 4A and 4B, the base 120 is shaped so as to provide alignment guides 390 configured to align the conductors 380 of the planar antenna 340 with the matching circuit 180 as the planar antenna 340 is inserted into the air gap 360 such that there is operative overlap between the planar antenna conductors 380 and the matching circuit 180. The surface area of the electrical contact between the planar antenna 340 and matching circuit 180 can accommodate thin (i.e., <1 millimeter) and porous materials.

The connector 140 may be any connector used to attach an antenna to a radio frequency (RF) communication device (such as the communication device 16 shown in FIG. 5). Suitable examples of the connector 140 include, but are not limited to, Type N connectors, UHF (PL259) connectors, (Threaded Neill-Concelman) TNC connectors, Reverse Polarity TNC (RPTNC) connectors, Bayonet Neill-Concelman (BNC) connectors, SubMiniature version A (SMA) connectors, and Reverse Polarity SMA (RPSMA) connectors. The connector 140 may be electrically coupled to the matching circuit in any suitable manner, as is known in the art.

The clamp arm 160 may be attached to the base 120 in any way that allows for the distal end 320 of the clamp arm 160 and the base 120 to form the air gap 360 when the planar antenna clamp system 100 is in the open configuration. For example, the proximal end 300 of the clamp art 160 may be rotatably or hingedly coupled to the base. In another example, the proximal end 300 of the clamp arm 160 is secured to the base 120 so as to form a cantilevered beam having elastic deflection properties that cause the distal end 320 of the clamp arm 160 to move away from the base 120 when in the open configuration. In one embodiment, a spring force (either external or internal to the clamp arm 160) causes the clamp arm 160 to move away from the base 120 when in the open configuration. Suitable examples of material from which the clamp arm 160 may be constructed include, but are not limited to, ABS, POM/Delrin, polylactic acid (PLA), Rexolite®, nylon, glass, and printed circuit board material (FR4, Rodgers, Teflon, etc.). It is preferable for the clamp arm 160 to be non-conductive.

The matching circuit 180 is designed to match the impedance of the planar antenna 340 to the impedance of the communications device 16. In one embodiment of the planar antenna clamp system 100, the matching circuit 180 is designed to match the impedance of the planar antenna 340 to a 50 ohm embodiment of the communication device 16. The matching circuit 180 is a matching network that can be designed with transmission lines or lumped elements. The matching circuit 180 may comprise passive or active electronics, or a combination of both, such as low noise amplifiers, filters, etc. The matching circuit 180 allows for antennas to be designed at impedances other than 50 ohms. By relaxing this constraint, different antennas can be designed and optimized for performance, transmission line spacing, and signal loss. The matching circuit 180 may be covered with a protective, non-conductive coating such that no metal-to-metal contact is used to couple the matching circuit 180 to the conductors 380 of the planar antenna 340. For example, the matching circuit 180 may be protected by a layer of dielectric material and operatively coupled to the planar antenna 340, when in the closed configuration, via inductive or capacitive coupling. In the embodiment of the planar antenna system 100 shown in FIG. 2, the matching circuit 180 is a passive, tapered transmission line, or more specifically a tapered co-planar waveguide transmission line. Other suitable examples of the matching circuit 180 include, but are not limited to, a two-wire line, a microstrip line, and a parallel-plate line.

The clamp 200 may be any device configured to press the conductors 380 of the planar antenna 340 against the matching circuit 180 between the clamp arm 160 and the base 120. Suitable examples of the clamp 200 include, but are not limited to, screws, springs, buttons, snaps, and snap tapes. FIGS. 2-5 show embodiments of the planar antenna clamp system 100 made of acrylic sheet, copper tape, and 3D printer material where the clamp 200 is a mechanical cam-lever locking arm comprising a lever 400 and a cam 410. The lever 400 has a distal end 420 and a proximal end 430. The proximal end 430 of the lever 400, in this embodiment, is rotatably coupled to the base 120. The cam 410 is mounted to the proximal end 430 of the lever 400 such that when the lever 400 is rotated with respect to the base into a first position (such as is shown in FIG. 3B) the cam 410 is disposed to apply force to the clamp arm 160 that causes the clamp arm 160 to move into, and remain in, the closed configuration. Rotating the lever 400 with respect to the base 120 into a second position (such as is shown in FIG. 4B) allows the clamp arm 160 to move into the open configuration.

Figure 6A:
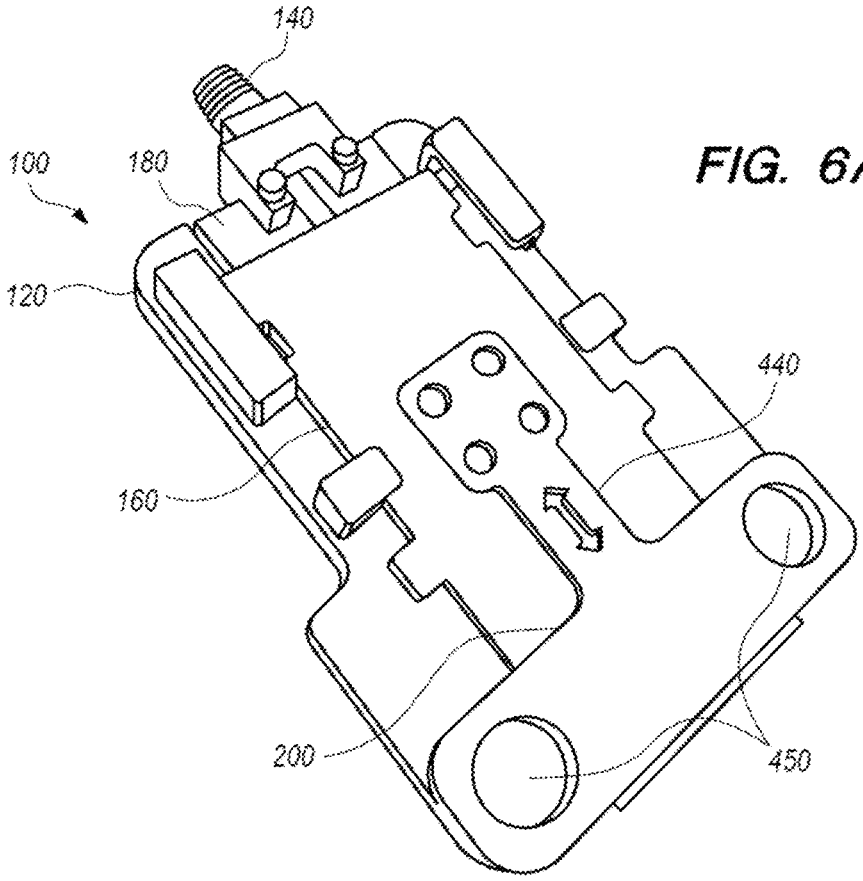
FIGS. 6A and 6B are perspective, top-view illustrations of an embodiment of a planar antenna clamp system.
Figure 6B:
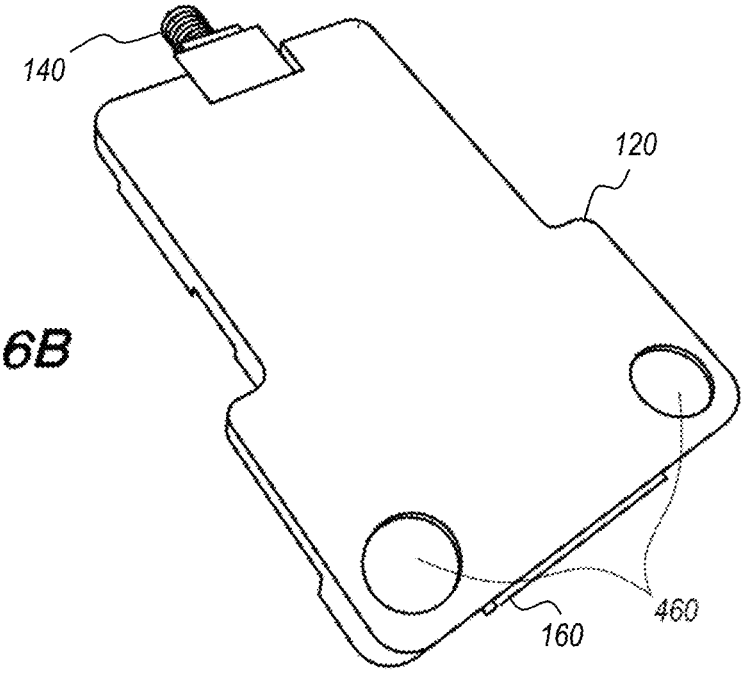
Figure 7A:
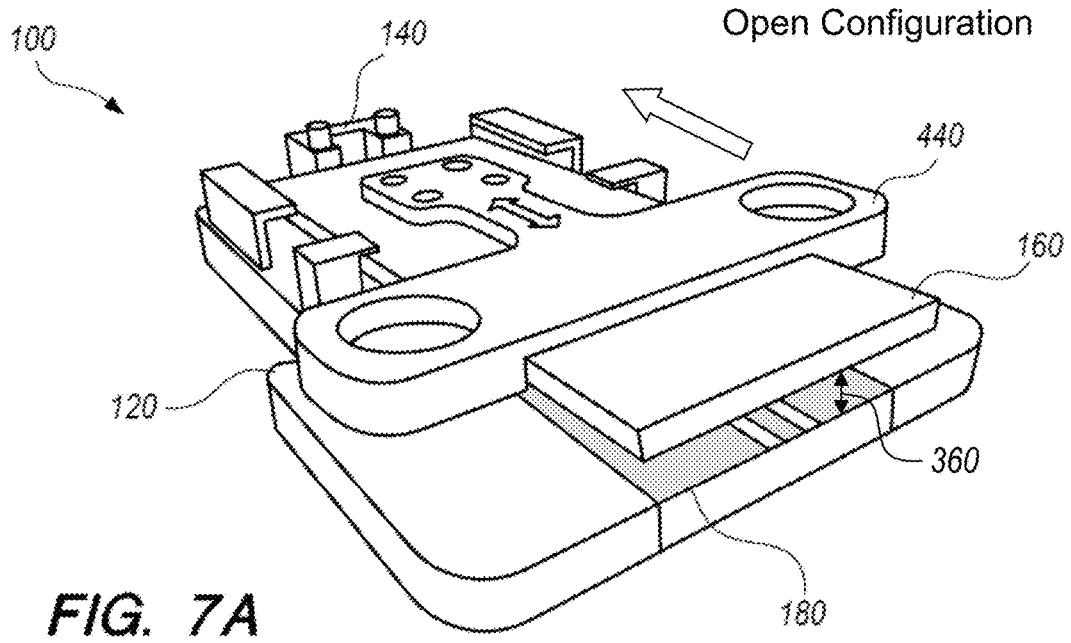
FIGS. 7A and 7B are perspective-view illustrations of an embodiment of a planar antenna clamp system in open and closed configurations respectively.
Figure 7B:
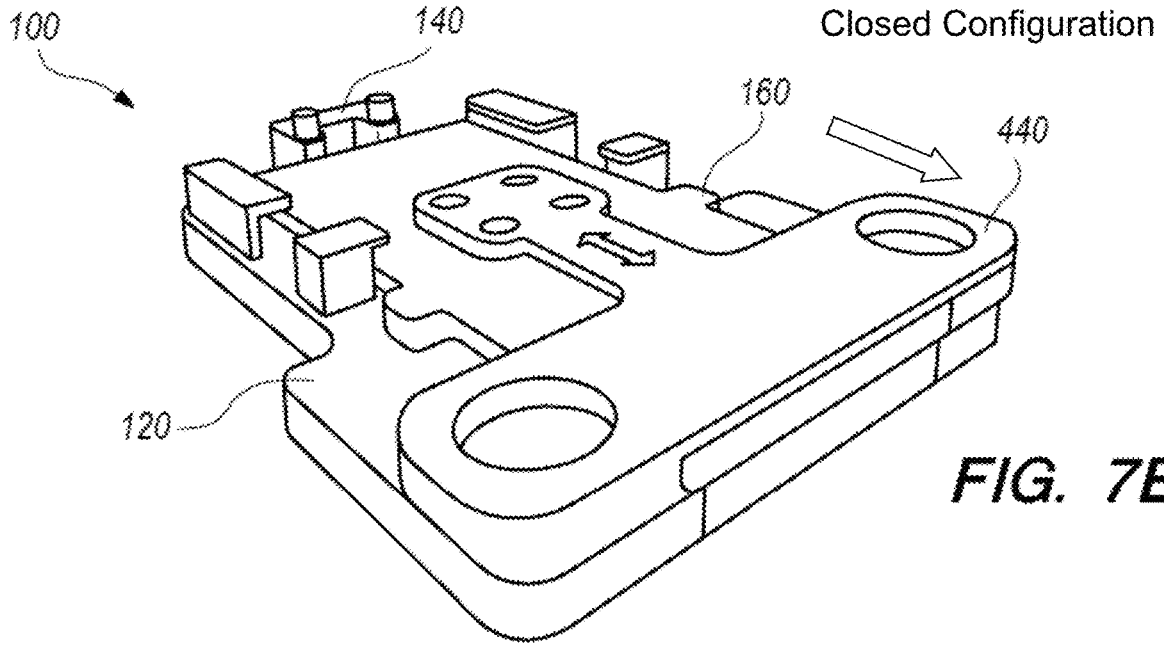
Figure 8A:
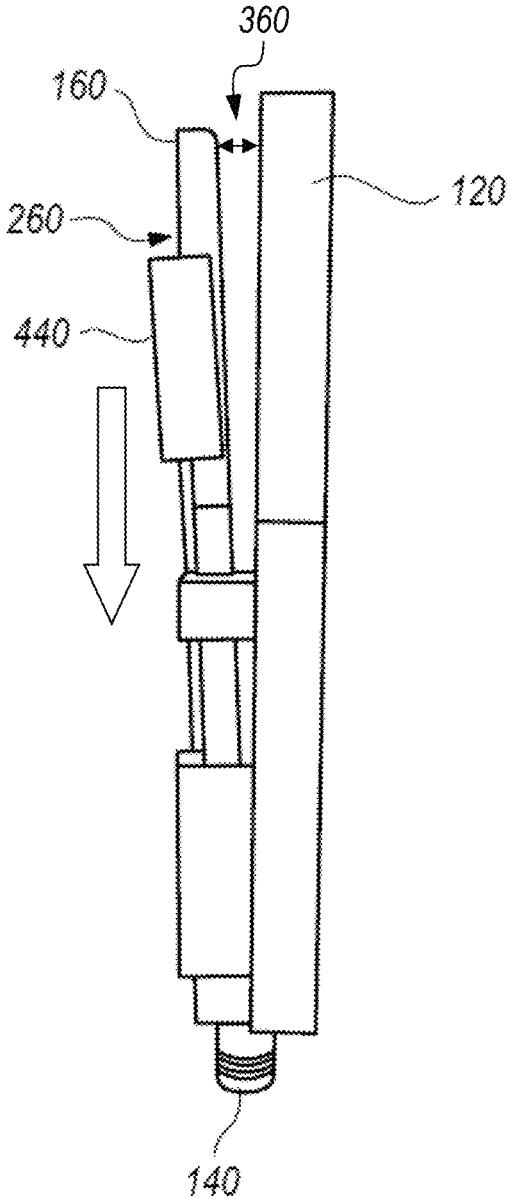
FIGS. 8A and 8B are side-view illustrations of an embodiment of a planar antenna clamp system in open and closed configurations respectively.
Figure 8B:
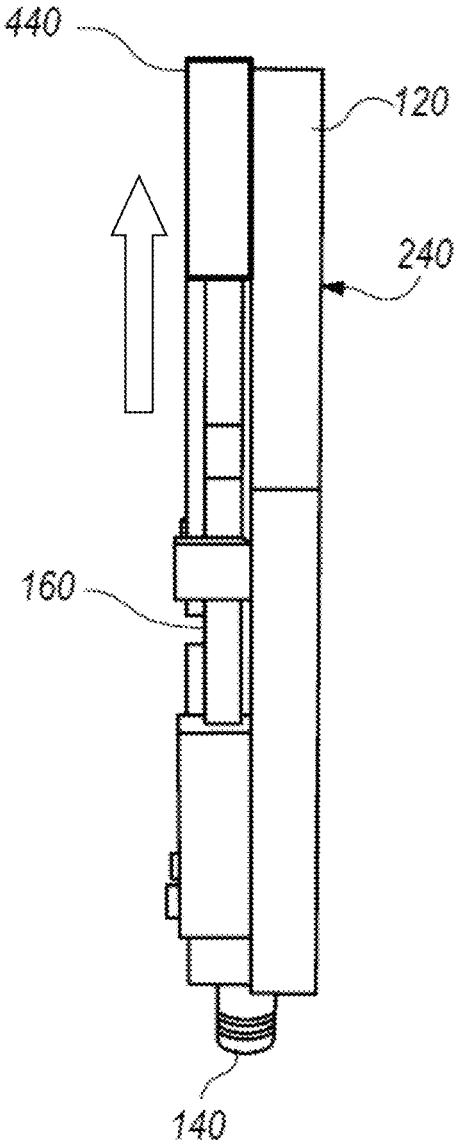

FIGS. 6A, 6B, 7A, 7B, 8A, and 8B are illustrations of an embodiment of the planar antenna clamp system 100 where the clamp 200 is a magnetic clamp comprising a clamp bar 440 a first magnet set 450 and a second magnet set 460. FIGS. 6A and 6B are respectively top and bottom perspective views of this magnetic clamp embodiment of the planar antenna clamp system 100. FIGS. 7A and 7B are respectively open and closed perspective views of this magnetic clamp embodiment of the planar antenna clamp system 100. FIGS. 8A and 8B are respectively open and closed side view illustrations of the magnetic clamp embodiment of the planar antenna clamp system 100. The clamp bar 440 is slidably disposed on the top surface 260 of the clamp arm 160 such that the clamp bar 440 can slide between a first position (shown in FIGS. 6A, 7B, and 8B) and a second position (shown in FIGS. 7A and 8A). The first position of the clamp bar 440 corresponds with the closed configuration and the second position of the clamp bar 440 corresponds with the open configuration of the planar antenna clamp system 100.

While the magnetic clamp embodiment of the planar antenna clamp system 100 shown in FIGS. 6A-8B has a first set of magnets 450 and a second set of magnets 460, it is to be understood that many different magnet clamp embodiments are possible with any number of desired magnets. In the illustrated example magnetic clamp embodiment the first magnet set 450 is mounted to the clamp bar 440. The second magnet set 460 is disposed in recesses on the bottom surface 240 of the base 120. In the first position, the first and second magnet sets 450 and 460 are vertically aligned such that there is attractive force between them thereby causing the clamp arm 160 to move into, and remain in, the closed configuration. When the clamp bar 440 is in the second position, the first and second magnet sets 450 and 460 are offset from each other so as to cause repulsive force therebetween thereby allowing the clamp arm to move into the open configuration. In some embodiments, the magnet sets 450 and 460 are positioned with respect to each other such that when the clamp bar 440 is in the second position, the repulsive force between the first and second magnet sets 450 and 460 lifts the clamp arm 160 into the open configuration. For example, in the illustration of the planar clamp antenna system 100 shown in FIGS. 7A and 7B, the cross-sections of the clamp arm 160 and a section of the clamp bar 440 are trapezoidal such that the clamp arm 160 fits within, and is held captive in, the clamp bar 440. This is done such that when the repulsive force between the first and second magnet sets 450 and 460 pushes the clamp bar 440 up, the clamp bar 440 pulls the clamp arm 160 up at the same time.

In some embodiments of the planar antenna clamp system 100, any magnetic or metallic components (other than the matching circuit 180) of the planar antenna clamp system 100 (such as magnets, screws, washers, etc.) are positioned vertically at least 1 mm away from the top surface 220 of the base 120 or the transmission line plane. If a metallic component is in the same plane as the transmission line, it needs to be 1 mm away from the gap 470 between a center conductor 480 and ground plane 490 (depicted in FIG. 2).

Figure 9A:
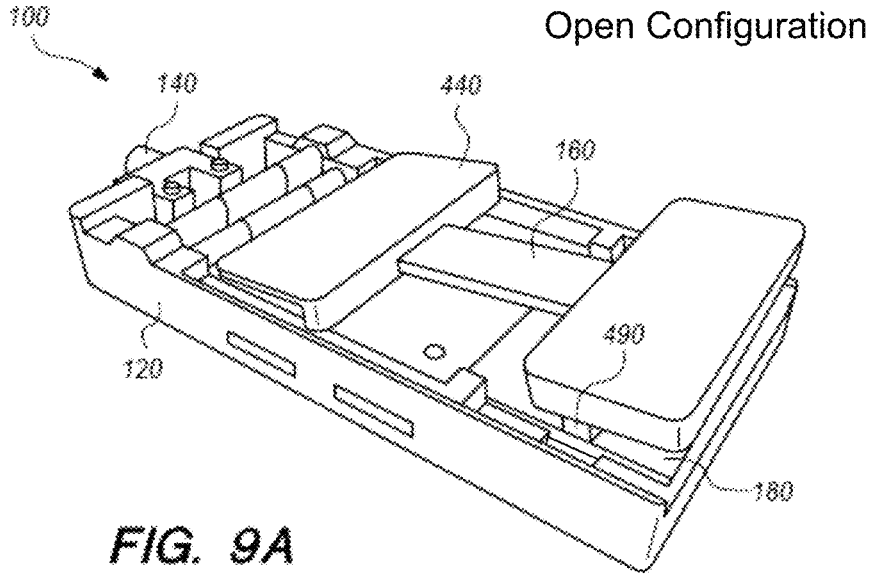
FIGS. 9A and 9B are respectively perspective and side-view illustrations of an embodiment of a planar antenna clamp system.
Figure 9B:
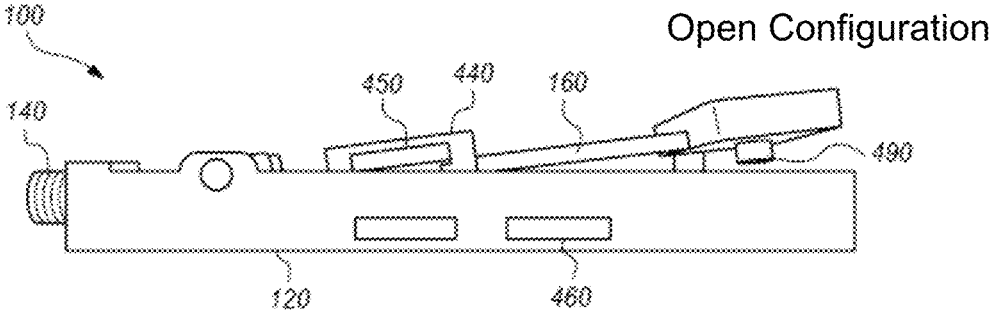
Figure 10A:
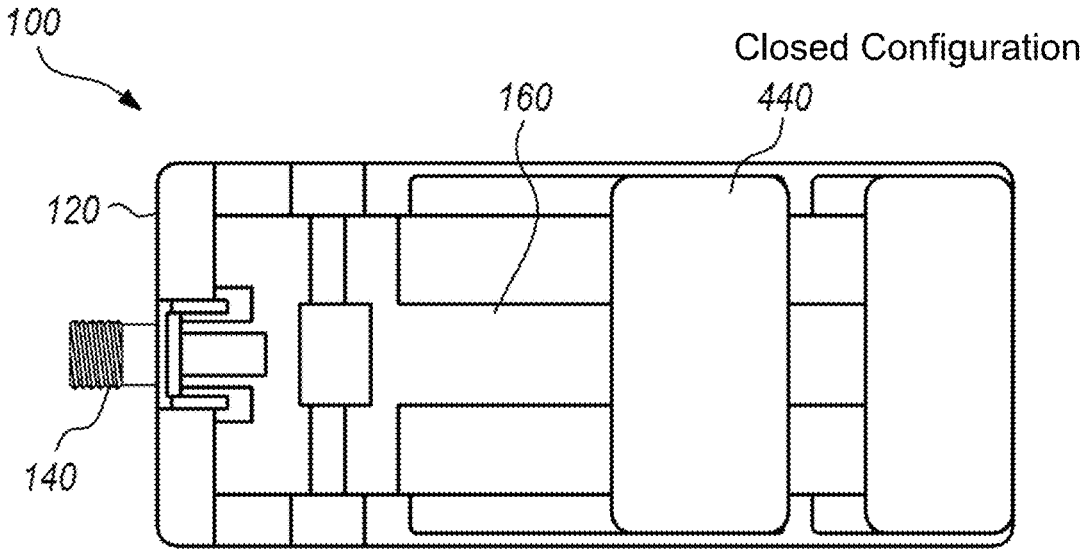
FIGS. 10A and 10B are respectively top and side-view illustrations of an embodiment of the planar antenna clamp system.
Figure 10B:
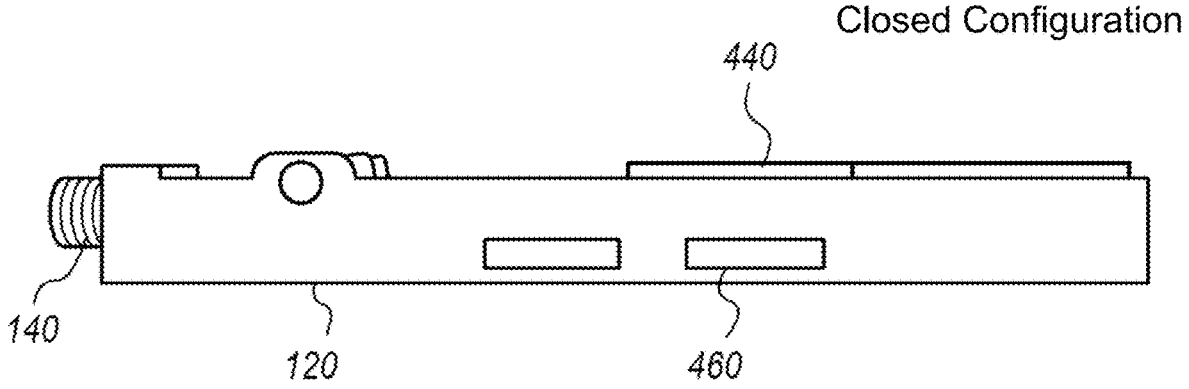

FIGS. 9A and 9B are respectively perspective and side-view illustrations of an embodiment of the planar antenna clamp system 100 in the open configuration that further comprises a lock feature 490 configured to prevent the planar antenna 340 from sliding with respect to the base 120 when the planar antenna clamp system 100 is in the closed configuration. FIGS. 10A and 10B are respectively top and side-view illustrations of the embodiment of the planar antenna clamp system shown in FIGS. 9A and 9B, but in the closed configuration. In some embodiments of the planar antenna clamp system 100, heat sensitive components in the matching circuit 180 and/or in the planar antenna 340 can be used in the matching circuit 180 and elsewhere because no soldering needs to be done on the antenna 340 or the planar antenna clamp system 100. Although, in some embodiments, soldering could be used if desired. The planar antenna clamp system 100 may be used to connect to other RF/microwave components with the appropriate transmission line feed, or the planar antenna clamp system 100 could be used to connect to a transmission line only (without an antenna or other RF component).

From the above description of the planar antenna clamp system 100, it is manifest that various techniques may be used for implementing the concepts of the planar antenna clamp system 100 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the planar antenna clamp system 100 is not limited to the particular embodiments described herein, but is capable of many embodiments without departing from the scope of the claims.

We claim:

1. A planar antenna clamp system comprising:

a base having a top surface;

a connector mounted to the base and configured to provide an interface to a communication device;

a clamp arm having top and bottom surfaces, wherein a proximal end of the clamp arm is mounted to the base such that, when in an open configuration, an air gap exists between the top surface of the base and the bottom surface of the clamp arm at a distal end of the clamp arm, and wherein the clamp arm and the base are oriented with respect to one another such that conductors of a planar antenna may be positioned in the air gap when in the open configuration;

a matching circuit disposed on the top surface of the base and electrically connected to the connector, wherein no solder is used to couple the matching circuit to the conductors of the planar antenna, wherein the base is shaped so as to provide alignment guides configured to align the conductors of the planar antenna with the matching circuit as a conductor end of the planar antenna is inserted into the air gap; and a clamp configured to compress the conductors of the planar antenna between the top surface of the base and the bottom surface of the clamp arm when the conductor end is inserted into the air gap and the clamp arm is in a closed configuration such that the conductors of the planar antenna are operatively coupled with the matching circuit thereby enabling operation of the planar antenna only when the clamp arm is in the closed configuration, and wherein when the clamp arm is in the open configuration, the planar antenna is not attached to the planar antenna clamp system and the planar antenna will not function.

2. The planar antenna clamp system of claim 1, wherein the connector is a subminiature version A (SMA) connector.

3. The planar antenna clamp system of claim 1, wherein no metal-to-metal contact is used to couple the matching circuit to the conductors of the planar antenna.

4. The planar antenna clamp system of claim 1, wherein the matching circuit comprises a tapered transmission line.

5. The planar antenna clamp system of claim 4, wherein the matching circuit is a tapered co-planar waveguide transmission line.

6. The planar antenna clamp system of claim 4, wherein the tapered transmission line is covered with a protective, dielectric layer such that the matching circuit is capacitively coupled to the conductors of the planar antenna when in the closed configuration.

7. The planar antenna clamp system of claim 1, wherein the matching circuit further comprises at least one active radio frequency (RF) component selected from the group consisting of: an amplifier, a diplexer, a mixer, and a filter.

8. The planar antenna clamp system of claim 1, wherein the clamp is a mechanical cam-lever locking arm comprising:

a lever having distal and proximal ends, wherein the proximal end of the lever is rotatably coupled to the base; and a cam mounted to the proximal end of the lever such that when the lever is rotated with respect to the base into a first position the cam is disposed to apply force to the clamp arm that causes the clamp arm to move into, and remain in, the closed configuration, and wherein the process of rotating the lever with respect to the base into a second position allows the clamp arm to move into the open configuration.

9. The planar antenna clamp system of claim 1, further comprising a spring disposed with respect to the clamp arm and the base so as to provide spring force to the distal end of the clamp arm in a direction away from the base.

10. The planar antenna clamp system of claim 9, wherein the clamp arm and the spring are both embodied in a cantilevered beam.

11. The planar antenna clamp system of claim 1, wherein the connector is a 50 ohm interface and the matching circuit is configured to match an impedance of the planar antenna to the 50 ohm interface.

12. The planar antenna clamp system of claim 1, wherein the clamp is a magnet clamp comprising:

a clamp bar slidably disposed on the top surface of the clamp arm such that the clamp bar can slide between first and second positions;

a first magnet mounted to the clamp bar;

a second magnet disposed on a bottom surface of the base; and wherein when the clamp bar is in the first position the first and second magnets are vertically aligned such that there is attractive force between them thereby causing the clamp arm to move into, and remain in, the closed configuration, and wherein when the clamp bar is in the second position, the first and second magnets are offset from each other so as to cause repulsive force there between thereby allowing the clamp arm to move into the open configuration.

13. The planar antenna clamp system of claim 12, wherein when the clamp bar is in the second position, the repulsive force between the first and second magnets lifts the clamp arm into the open configuration.

14. The planar antenna clamp system of claim 12, wherein any magnetic or metallic components of the planar antenna clamp system are positioned vertically at least 1 mm away from the top surface of the base.

15. The planar antenna clamp system of claim 1, further comprising a lock configured to prevent the antenna from sliding with respect to the base when the planar antenna clamp system is in the closed configuration.

16. The planar antenna clamp system of claim 1, wherein the clamp enables the planar antenna to quickly connect or disconnect from the matching circuit.

* * * * *